United States Patent [19]

Ruscitti et al.

[11] Patent Number: 4,899,913

[45] Date of Patent: Feb. 13, 1990

[54] HAND PUMP FOR DELIVERING THICK OR LIQUID SUBSTANCES CONTAINED IN BOTTLES

[75] Inventors: Tommaso Ruscitti, Milan; Davide Cutilli, Penne; Demetrio Del Leonardis, Spoltore, all of Italy

[73] Assignee: S.A.R. S.p.A., San Giovanni Teatino, Italy

[21] Appl. No.: 228,516

[22] Filed: Aug. 5, 1988

[30] Foreign Application Priority Data

Apr. 12, 1988 [IT] Italy ..... 20174 A/88

[51] Int. Cl.[4] ..... B67D 5/40

[52] U.S. Cl. ..... 222/385; 222/340; 222/321

[58] Field of Search ..... 222/321, 383, 385, 402.1, 222/402.24, 340, 341; 239/333; 417/513

[56] References Cited

U.S. PATENT DOCUMENTS

| | | | |
|---|---|---|---|
| 3,937,366 | 2/1976 | Steiman | 222/321 |
| 4,056,216 | 11/1977 | Kotuby | 222/385 |
| 4,174,055 | 11/1979 | Capra et al. | 222/319 |
| 4,485,943 | 12/1984 | Czech | 222/256 |
| 4,522,318 | 6/1985 | Del Bon | 222/402.24 |
| 4,526,302 | 7/1985 | Brunet | 222/321 |
| 4,607,765 | 8/1986 | Ruscitti | 222/321 |

FOREIGN PATENT DOCUMENTS

| | | |
|---|---|---|
| 893291 | 9/1982 | Belgium . |
| 8702986 | 4/1987 | Fed. Rep. of Germany . |
| 630998 | 7/1982 | Switzerland . |

*Primary Examiner*—Michael S. Huppert

*Attorney, Agent, or Firm*—Oblon, Spivak, McClelland, Maier & Neustadt

[57] ABSTRACT

A hand pump for delivering a predetermined quantity of paste or liquid substances contained in a bottle comprises an overall tubular hollow main body for receiving the pump operating members, including the operating stem which projects from one of the two ends of the main body. For retaining the stem within the body, the pump comprises a retention element with a hole through which the stem passes. The retention element is provided with projections or recesses arranged to respectively snap-engage corresponding recesses or projections provided in or on the main body.

16 Claims, 1 Drawing Sheet

HAND PUMP FOR DELIVERING THICK OR LIQUID SUBSTANCES CONTAINED IN BOTTLES

FIELD OF THE INVENTION

This invention relates to a hand pump for delivering a predetermined quantity of a liquid substance, including atomized or micronized delivery, or of a thick substance contained in bottles or containers.

BACKGROUND OF THE INVENTION

Pumps of this type are well known and comprise essentially a main hollow body of circular cross-section composed of coaxial portions of different diameter and housing all the pump operating members, including a coaxial stem projecting from one of the open ends of the main body. The stem is operated to deliver the substance contained in the bottle.

Specifically, delivery is obtained by pressing axially with the hand, in the direction of the main body, on a suitable knob fixed to the end of the stem projecting from the main body. The stem is returned to its rest or non-delivery position by the action of a return spring when the axial pressing action ceases.

The individual operating members of the pump are currently supplied to the user separate from each other and from the main pump body. The user must therefore manually assemble the various component pieces of the pump and finally close the aperture in the main body from which the stem extends by means of a cap having a coaxial hole through which the stem projects. The cap is not fixed to the main body and can only rest on one end of it. At an intermediate point on the stem there is provided a projecting collar which rests against the inner face of the cap to form a travel stop for the stem and thus define the rest position. A suitable gasket can be interposed between the collar and the cap. The return spring keeps the stem in its rest position.

The pump is fixed either directly to the bottle mouth or to a suitable ring nut which is then fixed to the bottle mouth. The ring nut can also be integral with the main body.

The bottle mouth, or the associated ring nut if not integral with the main body, are shaped to retain the cap in position together with the main pump body and the operating members contained in it. As stated, this cap only rests on the main body. Consequently, the various operating members which make up the pump can be maintained in position only when the pump has been fitted to the bottle or to the associated ring nut.

For further details of known pumps, reference should be made to utility model application No. 19981 A/87 and to USA Pat. No. 4,607,765.

As is apparent, manual assembly of the various component pieces of the pump is rather long and delicate because of the small size of some of these components and the fact that some pieces remain in position only after the cap has been added and the pump fitted to the bottle or ring nut. All this substantially influences bottling costs.

OBJECT OF THE INVENTION

It is an object of the present invention to provide a hand pump which the manufacturer of the various pump components can supply to the user already in a complete state ready for fitting to the bottle or to the associated ring nut.

SUMMARY OF THE INVENTION

The foregoing object is attained by the hand pump according to the invention, comprising an overall tubular hollow main body for receiving the pump operating members, including the operating stem which projects from one of the two ends of the main body, and an element for retaining the stem within the main body. The retention element comprises a hole through which the stem passes, and the stem is provided with an abutment element acting against the retention element. The pump is characterised in that the retention element comprises projections or recesses arranged to respectively, snap-engage corresponding recesses or projections provided in or on the main body.

The pump according to the invention is suitable for machine assembly, including the final fixing of the retention element to the main body, thus considerably reducing the pump cost.

The projections or recesses provided on or in the retention element and the corresponding recesses or projections provided in or on the main body are preferably of annular extension.

The pump is connected to the bottle mouth or to the associated ring nut by a normal snap-connection device.

BRIEF DESCRIPTION OF THE DRAWING

The invention will be more apparent from the description of some embodiments thereof given hereinafter by way of example only. In this description reference will be made to the accompanying drawing in which.

DETAILED DESCRIPTION OF THE PRESENTLY PREFERRED EMBODIMENTS

The First Embodiment

Figure 1:
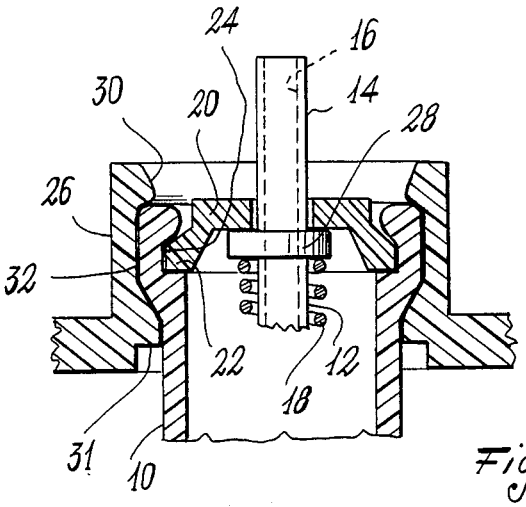
FIG. 1 is a partial axial section through a first embodiment of the pump according to the invention, the pump being shown already fitted to the bottle or to an associated ring nut.

In FIG. 1 the reference numeral 10 indicates a hollow main body of the hand pump, consisting of a single tubular element formed from coaxial portions of different diameter. The hollow main body 10 contains all the pump operating members, not shown for simplicity. The hollow main body 10 also contains a coaxial operating stem 12, the upper part 14 of which projects upwardly from the hollow main body 10. The substance contained in the associated bottle is delivered in known manner by pressing the upper part 14 of the operating stem 12 downwards by means of a suitable device, not shown. This causes the substance contained in the bottle to emerge through a coaxial passage 16 provided in the operating stem 12. A helical spring 18, which acts on an abutment element or collar 28 provided on the operating stem 12, returns the operating stem 12 to its rest or non-delivery position shown in FIG. 1. In this rest position, the collar 28 abuts against the inner surface of a cap 20, possibly by way of a suitable gasket (not shown on the drawing).

The operating stem 12 is thus retained in the rest position by a retention element in the form of an axially holed cap. It comprises an annular protuberance 22 arranged to snap-engage a corresponding annular recess 24 provided in proximity to the upper edge of the hollow main body 10.

The manufacturer of the various pump components can assemble them directly, this being conveniently done by machine, to provide the bottler with a complete pump ready for mounting on the bottle. The pump can thus be fitted either directly to a bottle or to a ring nut which is then fitted to the bottle, without having firstly to manually assemble the various pump components, with considerable time and thus cost saving. The bottle mouth, or the associated ring nut to be fitted to the bottle mouth, is visible in FIG. 1 and is indicated by the reference numeral 26.

To enable the pump to be fitted to the bottle or to the ring nut, the pump comprises an annular enlargement 32 on the hollow main body 10 in proximity to its upper edge to snap-engage between two corresponding circular ribs 30 and 31 provided in the bottle mouth or in the associated ring nut.

The Second Embodiment

Figure 2:
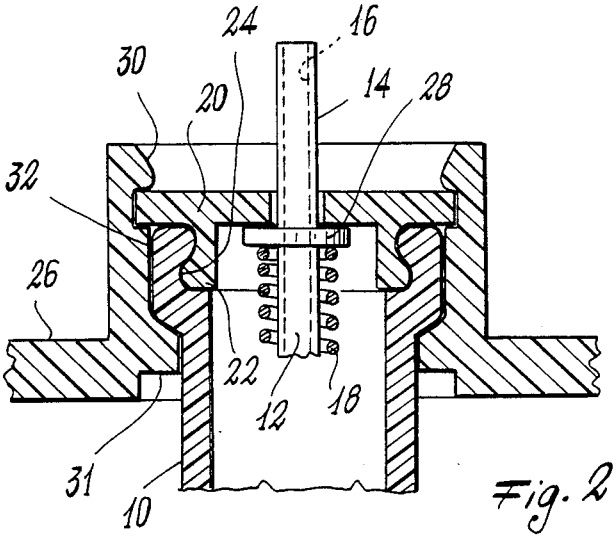
FIG. 2 is similar to FIG. 1 but shows a second embodiment of the invention.

In the embodiment shown in FIG. 2, parts corresponding to those of FIG. 1 are indicated by the same reference numerals. Specifically, the cap 20 has a shape resulting substantially from combining a cap of the known art (which engages directly with the bottle mouth or with the associated ring nut) with the cap of FIG. 1. In this respect, the cap of FIG. 2 has a larger diameter than the cap of FIG. 1 so that, in addition to snap-engaging the hollow main pump body 10, it also engages directly with the bottle mouth or ring nut 26. It therefore also forms part of the device for snap-connecting the pump to the mouth or to the ring nut.

We claim:

1. A hand pump comprising:
(a) a hollow main body having a first end and a second end;
(b) a cap snap-engaged in the first end of said hollow main body, said cap having:
(i) a through hole passing therethrough;
(ii) an outer surface and an inner surface relative to the interior of said hollow main body; and
(iii) a protuberance sized, shaped, and positioned to extend radially outwardly of said hollow main body and to be received in a first recess in an enclosure for a substance to be pumped;
(c) an operating stem slidably received in said through hole;
(d) a collar carried by said operating stem in position to abut against said inner surface of said cap to define one limit of travel of said operating stem; and
(e) means for biasing said collar against said inner surface of said cap.

2. A hand pump as recited in claim 1 wherein said cap is snap-engaged in the first end of said hollow main body by means of an annular protuberance on said cap and a corresponding annular recess in said hollow main body.

3. A hand pump as recited in claim 1 wherein said hollow main body has an annular external enlargement at its first end sized, shaped, and positioned to be received between said protuberance and a rib on said enclosure.

4. A hand pump as recited in claim 1 wherein said hollow main body has an external enlargement at its first end sized, shaped, and positioned to be received in a second recess in said enclosure.

5. A hand pump as recited in claim 4 wherein said first and second recesses are annular.

6. A hand pump as recited in claim 4 wherein said first and second recesses are immediately adjacent each other.

7. A hand pump as recited in claim 1 wherein said means comprises a compression spring one end of which abuts against said collar.

8. A hand pump as recited in claim 1 wherein said means comprises a helical spring disposed about said operating stem.

9. A hand pump as recited in claim 8, wherein said helical spring is a compression spring one end of which abuts against said collar.

10. A hand pump comprising:
(a) a hollow main body having a first end and a second end;
(b) a cup-shaped cap comprising a bottom, a peripheral side wall, and a lip snap-engaged in the first end of said hollow main body, said bottom having a through hole passing therethrough;
(c) an operating stem slidably received in said through hole;
(d) a collar carried by said operating stem in position to abut against said bottom of said cup-shaped cap above said lip of said cup-shaped cap to define one limit of travel of said operating stem; and
(e) means for biasing said collar against said bottom of said cup-shaped cap.

11. A hand pump as recited in claim 10 wherein said hollow main body has an annular external enlargement at its first end sized, shaped, and positioned to be received between two ribs on a ring nut.

12. A hand pump as recited in claim 10 wherein said hollow main body has an external enlargement at its first end sized, shaped, and positioned to be received in a recess in a ring nut.

13. A hand pump as recited in claim 12 wherein said recess is annular.

14. A hand pump as recited in claim 10 wherein said means comprises a compression spring one end of which abuts against said collar.

15. A hand pump as recited in claim 10 wherein said means comprises a helical spring disposed about said operating stem.

16. A hand pump as recited in claim 15 wherein said helical spring is a compression spring one end of which abuts against said collar.

* * * * *